US008523495B2

(12) United States Patent
Lacy

(10) Patent No.: US 8,523,495 B2
(45) Date of Patent: Sep. 3, 2013

(54) BULKHEAD ANCHORING SYSTEM FOR WATERWAYS

(76) Inventor: Franklin R. Lacy, Tampa, FL (US)

( * ) Notice: Subject to any disclaimer, the term of this patent is extended or adjusted under 35 U.S.C. 154(b) by 809 days.

(21) Appl. No.: 12/475,792

(22) Filed: Jun. 1, 2009

(65) Prior Publication Data

US 2010/0303554 A1 Dec. 2, 2010

(51) Int. Cl.
*E02D 5/76* (2006.01)
*E02D 29/02* (2006.01)

(52) U.S. Cl.
USPC ..... 405/284; 405/114; 405/272; 52/294

(58) Field of Classification Search
USPC ..... 405/107, 110, 112, 114, 272–275, 405/284, 286; 52/250–252, 292–294, 299, 52/300
See application file for complete search history.

(56) References Cited

U.S. PATENT DOCUMENTS

| | | | | |
|---|---|---|---|---|
| 804,939 | A | | 11/1905 | Feguson |
| 1,137,938 | A | | 5/1915 | Wemlinger |
| 1,672,122 | A | | 6/1928 | Hamlin |
| 1,778,574 | A | | 10/1930 | Thornley |
| 1,971,324 | A | | 8/1934 | Weber |
| 2,420,228 | A | * | 5/1947 | Condon ..... 405/286 |
| 3,195,312 | A | * | 7/1965 | Rumsey, Jr. ..... 405/287 |
| 3,225,548 | A | * | 12/1965 | Hayden ..... 405/286 |
| 4,000,622 | A | * | 1/1977 | Chiaves ..... 405/286 |
| 4,440,527 | A | * | 4/1984 | Vidal ..... 405/284 |
| 4,572,711 | A | * | 2/1986 | Benson et al. ..... 405/286 |
| 4,643,618 | A | * | 2/1987 | Hilfiker et al. ..... 405/287 |
| 4,718,792 | A | | 1/1988 | Louis |
| 4,911,585 | A | * | 3/1990 | Vidal et al. ..... 405/287 |
| 4,952,097 | A | | 8/1990 | Kulchin |
| 5,158,399 | A | | 10/1992 | Flores |
| 5,178,493 | A | * | 1/1993 | Vidal et al. ..... 405/284 |
| 5,468,098 | A | * | 11/1995 | Babcock ..... 405/262 |
| 5,669,737 | A | * | 9/1997 | Equilbec et al. ..... 405/262 |
| 5,707,183 | A | | 1/1998 | Akamine |
| 6,547,487 | B2 | | 4/2003 | Yang |
| 6,872,032 | B2 | | 3/2005 | Boys |

* cited by examiner

*Primary Examiner* — Tara M. Pinnock
(74) *Attorney, Agent, or Firm* — Clark A. Puntigam; Jensen & Puntigam, P.S.

(57) ABSTRACT

The bulkhead anchoring system includes a plurality of concrete slabs which are sufficiently heavy to remain in place on a bottom surface of a waterway, due to high suction produced by the bottom of the waterway on the slabs. The slabs are positioned close to or adjacent the bulkhead. Risers extend vertically upwardly from the concrete slabs, at the rear corners thereof, positioned such that the risers are in contact with the bulkhead. The risers are concrete if the waterway is saltwater or can be galvanized steel if the waterway is fresh water.

20 Claims, 5 Drawing Sheets

BULKHEAD ANCHORING SYSTEM FOR WATERWAYS

TECHNICAL FIELD

This invention relates generally to bulkhead systems used in waterways, and more specifically concerns a bulkhead anchoring system for use with existing or new bulkheads to prevent the bulkhead and/or bank from collapsing into the waterway.

BACKGROUND OF THE INVENTION

Bulkheads are generally needed for use against banks which are adjacent to waterways, such as lakes, canals, rivers, etc., to provide a defined raised bank-to-waterway edge and to prevent the banks from collapsing into the waterways. The banks may conventionally be dirt and can include rocks, sand, clay or a combination of those and other is soils. However, the bulkheads themselves often deteriorate, shift and even collapse, due to compressive forces against the bulkhead produced by the banks and/or water seepage. Bulkheads are expensive to maintain and replace. One solution used in the past has been to drive pilings and/or sluice slabs for the bulkheads vertically deep into the below-water-table ground, including to bedrock, to provide a more stable bulkhead system. However, such a solution is expensive and in some cases is still not completely effective. Such systems further lack stability at the waterway bottom, where failure of many bulkhead systems begin.

Hence, it is desirable to have a bulkhead system or an ancillary anchoring system which is effective to prevent the bulkhead from moving or collapsing into the waterway, while at the same time is reliable over the long term, and which can be used with existing as well as new bulkheads. It is further desirable that such a system be relatively low in cost compared to existing systems such as vertically deep and/or bedrock anchoring systems.

SUMMARY OF THE INVENTION

Accordingly, the waterway bulkhead anchoring system comprises: a plurality of slab members, sufficiently heavy and configured so as to remain in place, due to suction action, on a bottom surface of a waterway, the slab members being positioned in combination with and close to or adjacent a waterway bulkhead so as to stabilize the bulkhead and prevent it from collapsing into the waterway.

BEST MODE FOR CARRYING OUT THE INVENTION

FIGS. 1, 4, 5 and 6 show a basic bulkhead anchoring system for a pre-existing bulkhead, referred to generally at 10. Bulkhead 10 can take various forms, including concrete, wood, metal, or various combinations thereof. Bulkhead 10 is used along various waterways 13, including rivers, canals, lakes and the like. Bulkhead 10 can be of various sizes, with various heights and lengths, depending upon the particular waterway and the bank configuration. Bulkhead 10 is positioned and designed to restrain a bank behind it which forms the edge of the waterway. Bank 12 comprises various soils and other elements, including dirt, sand, clay, rocks, vegetation and other material, including ground water. Bulkhead 10 may or may not include a bulkhead beam, shown at 14, which extends along the length of the bulkhead 10. The bulkhead beam 14 will typically, but not necessarily, be concrete.

Figure 1:
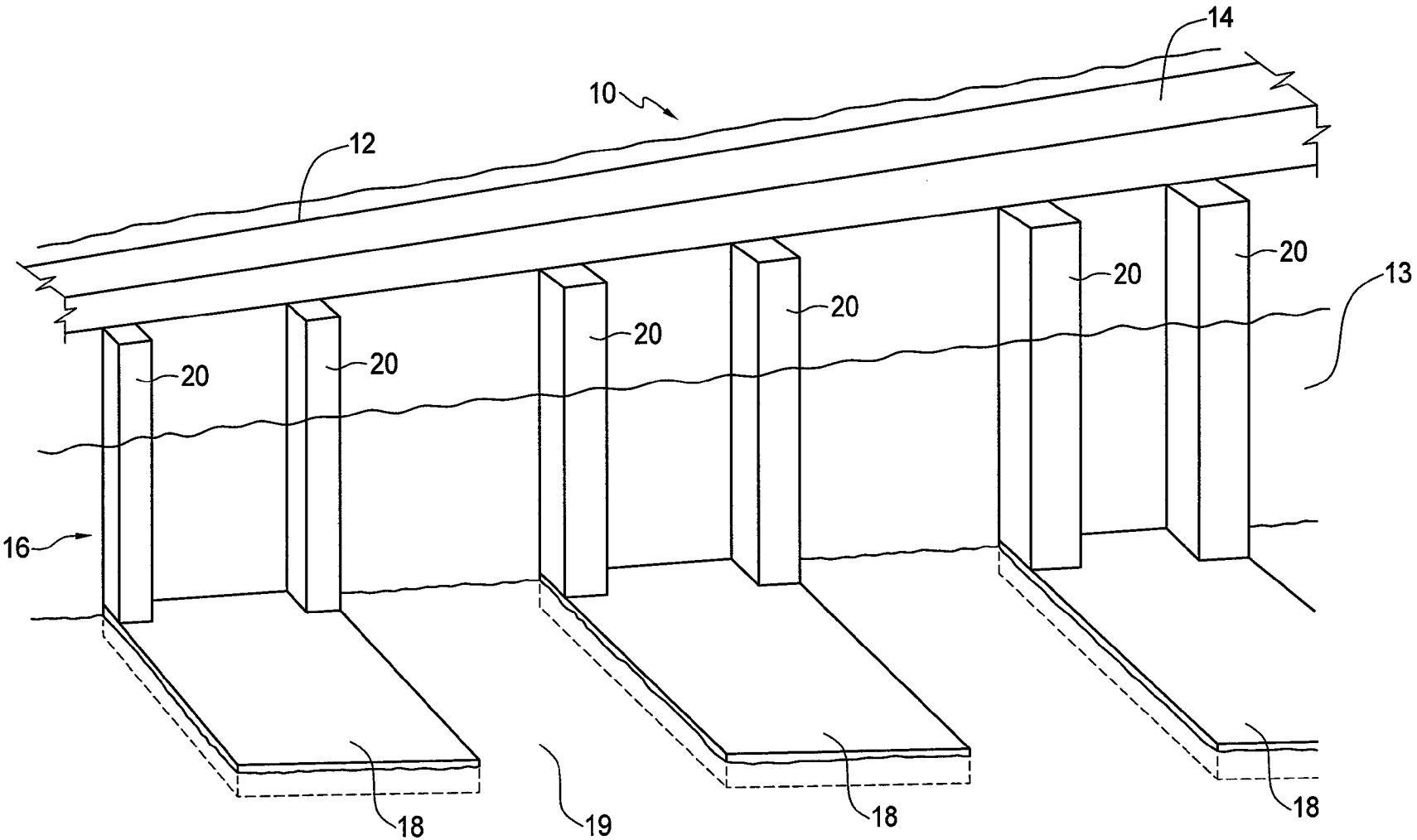
FIG. 1 is a perspective view of a bulkhead anchoring system, for a pre-existing bulkhead.

Bulkhead 10 in FIG. 1 is continuous along its length. One embodiment of a bulkhead anchoring system, referred to generally at 16, includes a plurality of concrete slabs 18-18. In the embodiment shown, each slab 18 is approximately 8 ft. by 8 ft. by 12 inches thick. The slabs could, however, be different sizes depending upon the particular application. In the embodiment shown, each slab weighs approximately 10,000 pounds. The slab weight can also vary. Concrete slabs 18 can include rebar if desired for additional strength. The concrete slabs comprise cement, as well as water reducing additives, such as acrylic latex, polycarboxalate polymers, or other water-based polymers. In addition, fly ash can be added to the mix to increase the density and the water intrusion resistance. A 0.40-0.45 water to cement ratio during mixing is preferred. Water intrusion preventing products are widely commercially available.

The slabs 18 are positioned on the bottom 19 of the waterway 13 adjacent to the bulkhead 10. The slabs are embedded in the waterway bottom 19. The embedded slabs force out all the air and almost all the water beneath them so that in effect they are sealed in the bottom material of the waterway. A partial vacuum is formed due to the weight and pressure of the water when any side pressures are exerted against the slabs. The natural suction of the bottom 19 material under and around slabs 18 holds them securely in place so they will not move under bulkhead forces once they are in place. The bottom material, usually mud and other soils, will typically surround the slab so that the material comprising the bottom 19 of the waterway is in continuous physical contact with the bottom of the slab and the sides thereof due to the weight of concrete slabs 18. A powerful suction force is produced, sealing slabs 18 to the bottom of the waterway or somewhat above, which more than offsets any force exerted by the bulkhead or the bank behind the bulkhead. The suction action is similar to a thin disc being caught against the drain in a single drain pool. The partial vacuum created in the drain underneath the disc (i.e. the difference in pressure above and below the disc) will prevent the disc from moving sideways, even though the disc may weigh relatively little. Suction provides resistance to horizontal movement. With the present bulkhead anchoring system, there is of course no drain. As a result, a relatively heavy slab which is embedded in the waterway bottom material produces a suction force that resists horizontal forces and collapsing of the bulkhead. The suction force is as important, if not more important, than the weight of the slab per se.

Typically, the individual slabs 18 will be separated by a small distance, such as 12 in., although this can vary, in some cases up to 8 feet or even more. Two slabs are typically positioned at the opposing ends of the bulkhead, although this again is not necessary, but may be preferred in typical applications. The slabs 18 provide the basic anchoring function for the anchoring system 16 and creates significant stability, a fulcrum of stability at the approximate plane of the bottom of the waterway 19.

Each slab 18 in the embodiment of FIG. 1 has a plurality of risers 20-20 which extend vertically therefrom. The risers are attached to or are part of the slabs 18. Slab 18 will typically have two risers 20, one at each rear corner thereof, although this is not necessary, in some cases a single riser per slab will be sufficient.

In the embodiment shown, the vertical risers 20 are 12 in. by 12 in. square, although this can vary depending upon the application, and can include rectangular or circular cross-sectional configurations. Typically, risers 20 will extend to just below the top of the bulkhead 10. In one example the bulkhead is approximately 8 ft. high. Risers 20 are rigid and made out of concrete, similar to slabs 18 with ½ inch rebar (typically) added for additional strength. However, for fresh water waterways, such as rivers, the risers 20 can be made from galvanized steel.

The risers 20 are arranged so that they are in contact with the bulkhead 10 at least at one point but not attached thereto, although, in some cases, the risers could actually be secured to the bulkhead 10. The risers 20, anchored to the slabs 18, have the function of maintaining the bulkhead 10 from moving toward the waterway.

Figure 2:
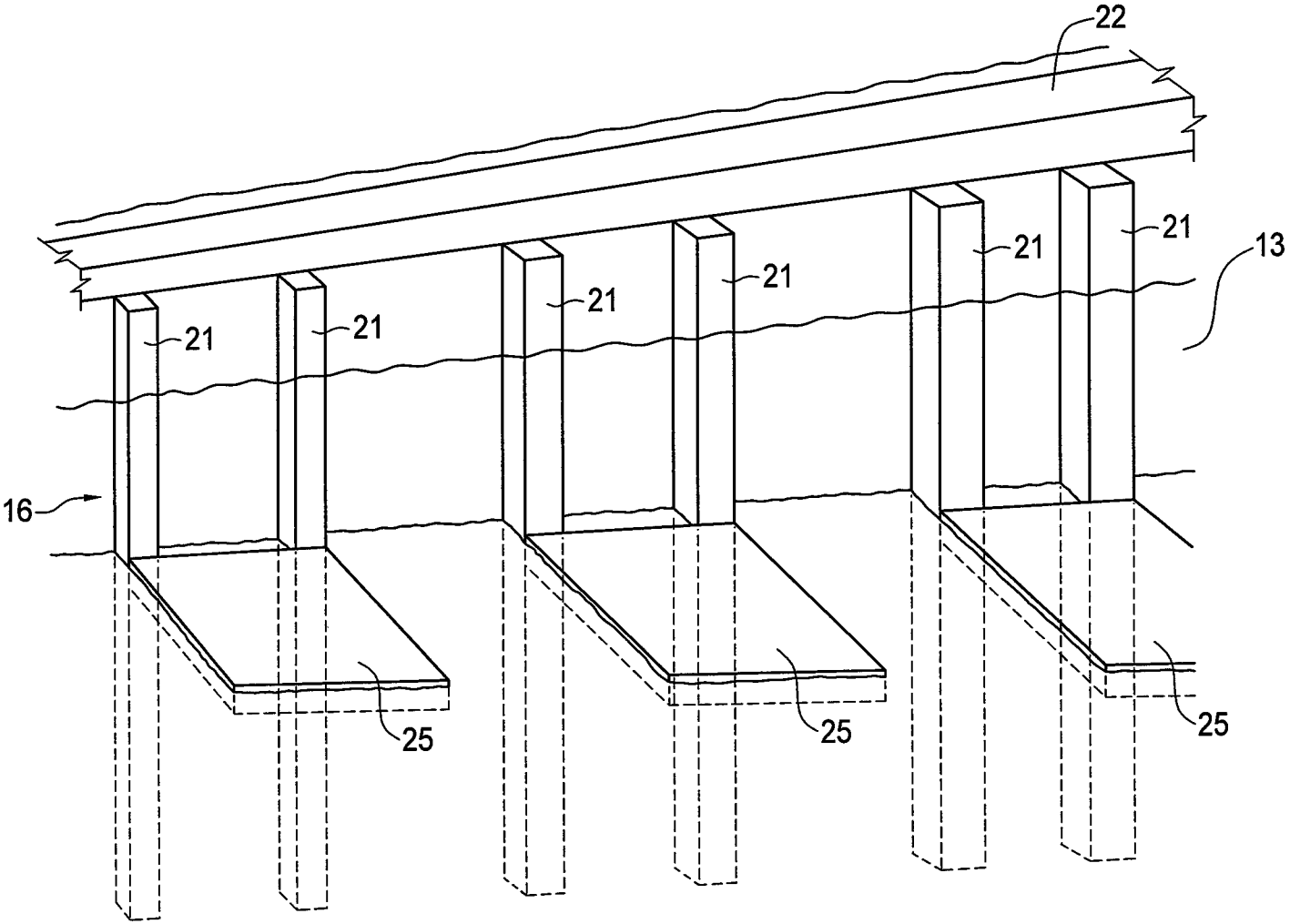
FIG. 2 is a perspective view of an alternative bulkhead anchoring system.

FIG. 2 shows an alternative to the riser arrangement of FIG. 1. In FIG. 2, vertical pilings 21-21 are provided as part of or against the bulkhead (not shown). The piling 21 are sunk deeply into the waterway bottom along the bulkhead. The slabs 25-25 press against the pilings and act as a fulcrum of support against the pilings. Pilings 21 could be made from wood. Extending across the tops of the pilings 21 could be positioned a beam 22 which is attached to and connects the tops of the pilings 21, although this is not necessary. The beam 22 will typically be made from concrete, or other materials such as steel or even wood. The beam 22 is arranged to stabilize the tops of individual pilings and maintain them in a specific relationship to each other.

Figure 3:
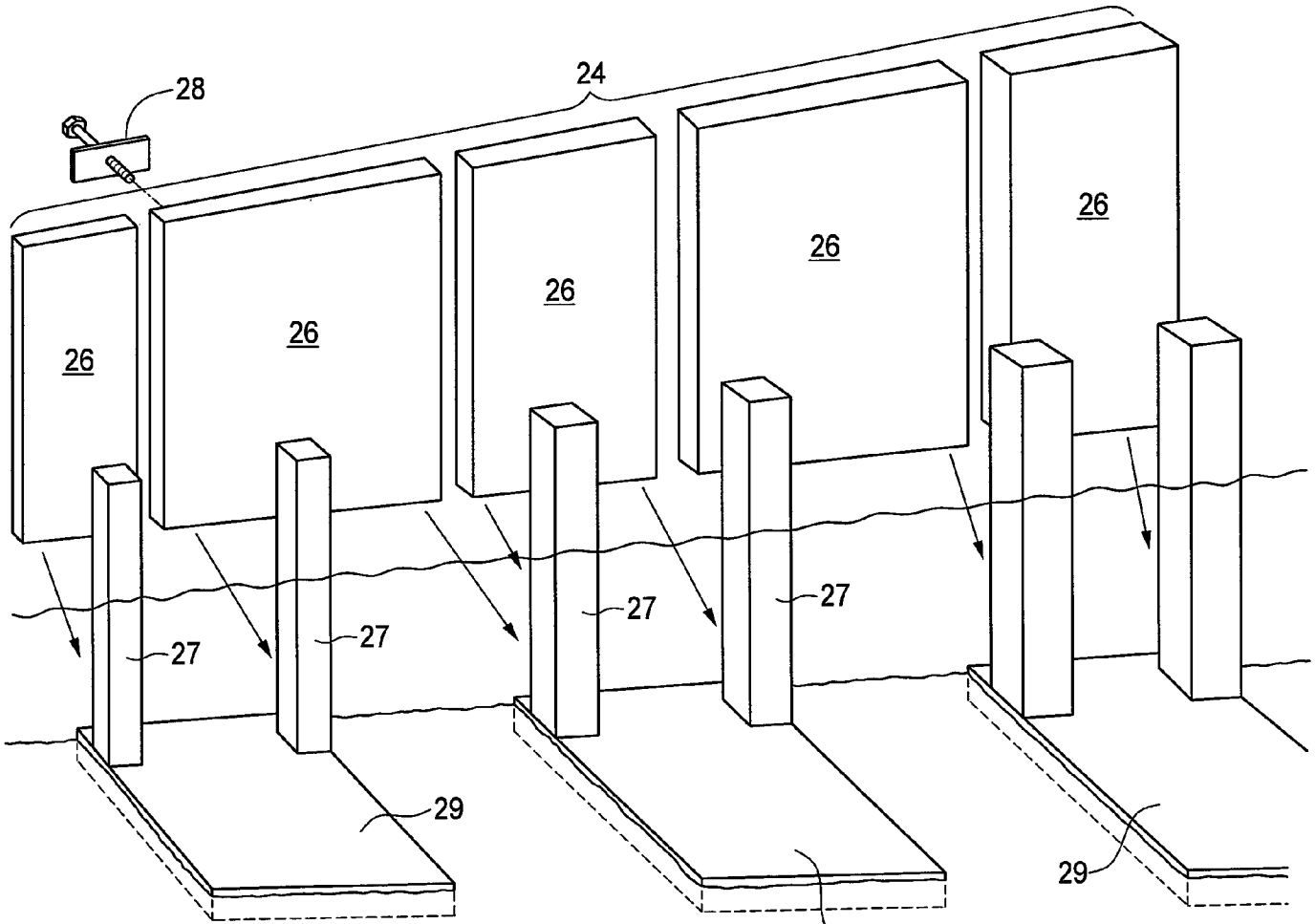
FIG. 3 is a perspective view of an anchoring system for a new bulkhead.

FIG. 3 shows a similar arrangement to FIG. 1, except the bulkhead is new. The bulkhead and its associated anchoring system are thus typically constructed and installed at the same time. In this arrangement, the new bulkhead 24 comprises a plurality of individual sections 26-26, in combination with risers 27. Concrete slabs like that shown in FIG. 1 are referred to at 29. Bulkhead 24 will be made of conventional bulkhead materials, such as concrete, steel, wood and the like. Bulkhead 24 does not require anchoring pillars to be deeply driven such as down to bedrock. Neither do the vertical sections 26 need to be deeply embedded or sluiced into the waterway bottom. The individual sections 26 can be connected together with risers 27 by an arrangement of plates and bolts shown at 28.

Figure 3A:
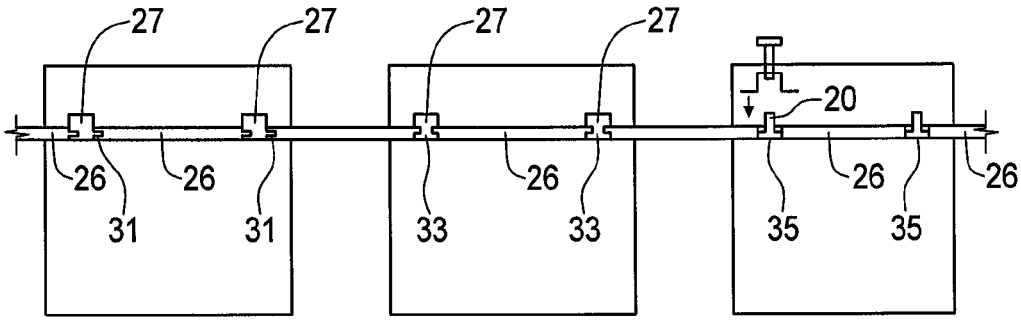
FIG. 3A is a top view of an alternative to FIG. 3 using vertically oriented spanning panels between successive risers.
Figure 4:
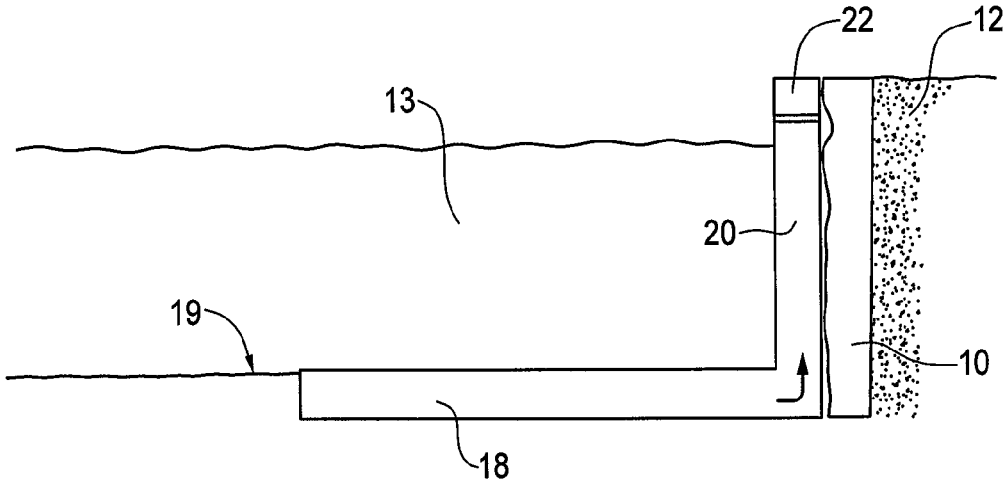
FIG. 4 is a side elevational view of the bulkhead anchoring system of FIG. 1.
Figure 5:
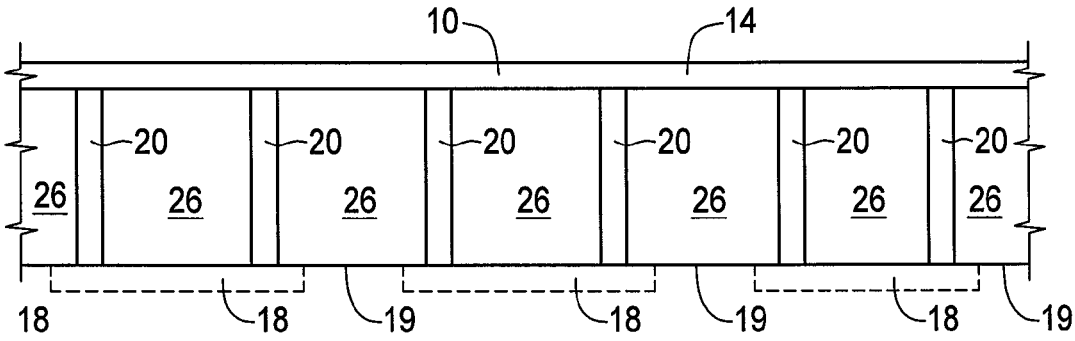
FIG. 5 is a front elevational view of the bulkhead anchoring system of FIG. 1.
Figure 6:
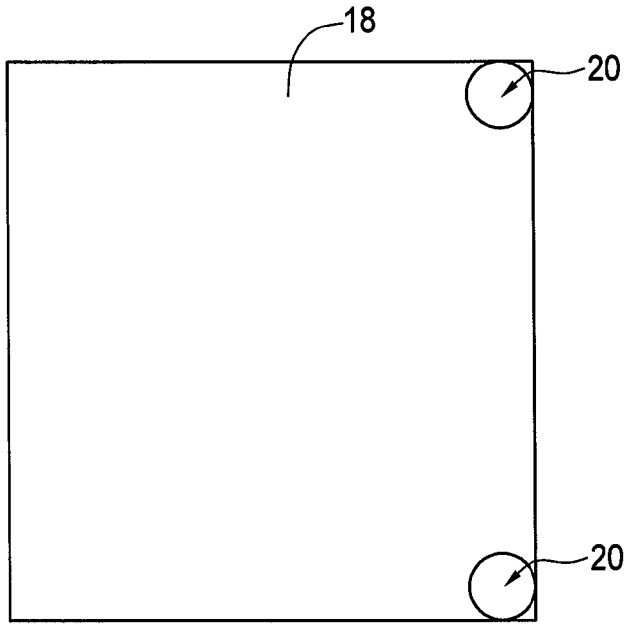
FIG. 6 is a top view of a portion of the bulkhead anchoring system of FIG. 1.

A flush appearance of the bulkhead can be produced by aligning sections 26-26 with risers 27-27, as shown in FIG. 3A. The vertical edges of sections 27 are connected to the vertical edges of the risers by tongue and groove connections shown at 31, dado-type connections shown at 33, or dado-type components with a T-shaped riser, hat-shaped bracket and bolt, shown at 35. Other connecting arrangements can be used. With rebar arranged to protrude from the upper surfaces of sections 26 and risers 27, a capping beam can be used to connect all the parts together and present a smooth bulkhead appearance. Designs of animals, landscapes, etc. can be carved, molded or embossed into the bulkhead sections facing the waterway.

The above-described bulkhead anchoring system results in secure protection against the compressive forces of the bank behind the bulkhead which tend to move a pre-existing or new bulkhead into the adjacent waterway. It accomplishes this desired result by a series of slabs which are maintained in position on the waterway floor by a powerful suction force. This provides the desired stable anchoring function without having to drive pilings or other members deeply down into the waterway bottom or to bedrock. Individual risers, which extend upwardly vertically from the slabs, typically two to a slab, maintain contact with the bulkhead but are not secured thereto. Hence, there can be a moving contact between the risers and the bulkhead, as the bulkhead may shift or settle in position due to action of the bank. The risers, along with the slabs as an anchor, prevent the bulkhead from moving or collapsing into the waterway. This is a relatively low-cost but effective alternative to expensive bedrock or deep anchoring systems. It is fast and convenient to use with existing bulkheads as well as new bulkheads. With use of the present system, any excavation of the bank is minimized. Expense associated with replacement of old bulkheads with removal of material encroaching onto landscaping and house foundations is also minimized. Dock piers can as an option be part of or mounted to or rise above the concrete slabs, either as part of or independent of a bulkhead.

Although a preferred embodiment has been disclosed for purposes of illustration, it should be understood that various changes and modifications and substitutions could be made in the preferred embodiment without departing from the spirit of the invention as defined by the claims which follow:

What is claimed is:

1. The combination of a waterway bulkhead and anchoring system therefor, comprising:

a plurality of slab members, configured so as to remain in place as suction anchors due to suction action on a bottom surface of a waterway, the slab members being positioned in combination with and adjacent a waterway bulkhead, such that a majority of each slab extends out from the bulkhead into the waterway and further extends a distance up a front surface of the bulkhead, so as to stabilize the bulkhead and prevent it from collapsing into the waterway.

2. The anchoring system of claim 1, wherein the slab members are concrete.

3. The anchoring system of claim 2, including a plurality of risers secured by or part of the concrete slabs and extending vertically upwardly therefrom, positioned such that the risers are in contact with the front surface of the bulkhead, wherein the combination of the slabs and the risers tends to prevent the bulkhead from collapsing into the waterway.

4. The anchoring system of claim 3, wherein the concrete slabs are spaced apart, with slabs positioned in the vicinity of the opposing ends of the bulkhead.

5. The anchoring system of claim 3, wherein the slabs are positioned in combination with the bulkhead such that there results a point of stability at the bottom of the waterway against the bulkhead.

6. The anchoring system of claim 3, including a cross beam which extends across the risers.

7. The anchoring system of claim 3, wherein the slabs are at least 10,000 pounds, are approximately 8 ft×8 ft×12 inches, and are separated from each other along the bulkhead.

8. The anchoring system of claim 3, wherein the risers extend to a point below the top of the bulkhead.

9. The anchoring system of claim 3, wherein the waterway bulkhead includes vertical bulkhead members positioned between or behind the risers.

10. The anchoring system of claim 9, wherein the risers are positioned forward of the rear edge of the slab members.

11. The anchoring system of claim 9, wherein the vertical bulkhead members are joined to the risers by tongue and groove joints or by dado joints.

12. The anchoring system of claim 9, including decorative material on the vertical bulkhead members.

13. The anchoring system of claim 9, including rebar members extending from a top edge of the vertical bulkhead members.

14. The anchoring system of claim 13, including a horizontal beam member extending along tops of the vertical bulkhead members and tops of the risers, held by connection to the rebar members.

15. The anchoring system of claim 9, wherein the vertical bulkhead members are concrete.

16. The anchoring system of claim 9, wherein the vertical bulkhead members are positioned so as to permit ground water from the bank to flow between a lower surface of the vertical bulkhead members and the slab member.

17. The anchoring system of claim 2, wherein the risers are positioned at approximately the rear corners of each slab, adjacent to the bulkhead, such that there results a physical contact between the bulkhead and the risers, with direct attachment between the bulkhead and the risers.

18. The anchoring system of claim 2, wherein the risers are concrete with steel rebar therein.

19. The anchoring system of claim 18, wherein the concrete slabs and the risers include at least one additive and are constructed and arranged to increase the density of the slabs to prevent salt water intrusion.

20. The anchoring system of claim 2, wherein the risers are galvanized steel or concrete.

* * * * *